United States Patent [19]

Cater, Sr.

[11] Patent Number: 4,932,694

[45] Date of Patent: Jun. 12, 1990

[54] WINDOW AND DOOR LOCK

[76] Inventor: Leavie Cater, Sr., 305 W. Polk St., Santa Maria, Calif. 93454

[21] Appl. No.: 291,282

[22] Filed: Dec. 28, 1988

[51] Int. Cl.[5] ..... E05C 3/00

[52] U.S. Cl. ..... 292/210; 292/DIG. 20; 292/DIG. 46

[58] Field of Search ..... 70/89, 95; 292/DIG. 20, 292/210, DIG. 46, DIG. 47, 108

[56] References Cited

U.S. PATENT DOCUMENTS

| | | | |
|---|---|---|---|
| 1,684,980 | 9/1928 | Ward et al. | 70/95 |
| 2,682,424 | 6/1954 | Adams et al. | 292/DIG. 46 X |
| 2,855,234 | 10/1958 | Eads | 292/DIG. 46 X |
| 3,347,584 | 10/1967 | Johnstone | 292/210 X |
| 3,565,476 | 2/1971 | Berman | 292/210 X |
| 3,705,505 | 12/1972 | Landow et al. | 292/DIG. 46 X |
| 4,134,281 | 1/1979 | Pelcin | 292/210 X |
| 4,167,281 | 9/1979 | Spencer | 292/210 X |
| 4,434,635 | 3/1984 | Borgato | 70/95 X |
| 4,583,381 | 4/1986 | Sjogren | 70/95 |

*Primary Examiner*—Lloyd A. Gall

*Attorney, Agent, or Firm*—Milton S. Gerstein

[57] ABSTRACT

A lock for interior use for locking sliding windows and doors to prevent greater security and safety. The lock is provided with a pivotal blocker-arm that blocks movement of the sliding member of the window or door. A locking lever locks the blocker-arm in its locking state until released by a spring-biassed latching lever. A protective pivotal shield is provided that prevents access to the locking lever to prevent the unlocking thereof regardless of the position of the latching lever, and which allows access to the locking lever in a second state to allow unlocking of the locking lever but denying unlatching of the latching lever. The locking lever can only be unlocked if the latching lever is first unlatched followed by the positioning of the shield in its second state adjacent the latching lever.

10 Claims, 2 Drawing Sheets

WINDOW AND DOOR LOCK

BACKGROUND OF THE INVENTION

The present invention is directed to a locking mechanism for use in sash windows, sliding patio doors, and the like, where entry from the outside is to be prevented when desired. The present invention is directed to selectively locking two movable sliding window or door parts, such that the parts cannot be slid relative to each other, whereby entry from the outside is effectively prevented, owing to the unique and novel manner by which the lock of the invention operates and by the manner by which it is released or unlocked. There are, of course, numerous types of locking structures that are used to prevent the relative sliding of a window sash or sliding door. For window sashes, a simple rotatable cam element is used on the upper portion of the lower window sash frame, which cooperates with a detent element on the juxtapositioned lower portion of the upper window sash, such being easily opened or unlocked from the outside by merely breaking the pane of glass, and extending one's arm interiorly to thereafter rotate the locking cam. Various other locks are also used, all of which suffer from the same disadvantage of allowing the unlocking or opening thereof from the outside, where the lock does not utilize a key-and-cylinder arrangement or is not a combination lock. With regard to patio doors, or other sliding doors, the typical lock employed is secured to the sliding door itself and operates in the same manner as all conventional locks, allowing the opening or unlocking thereof from the outside, when a key-and-cylinder or combination lock is not used. The present invention combines the safety benefits of a key-and-cylinder or combination lock with the ease-of-opening benefits of a conventional lock not controlled via a key or combination, so that entry from the outside is more effectively prevented as compared to the keyless locks, while being more easily operated from the inside as compared with a key-type lock.

SUMMARY OF THE INVENTION

It is the primary objective of the present invention to provide a locking mechanism for locking sash windows, sliding patio doors, and the like, such that forced entry from the outside is more effectively prevented, without the need of providing another or additional key or combination lock, and also for preventing easy opening of the window or door from the interior or inside, in order to more effectively protect toddlers and children from gaining access to dangerous areas, such as balconies, and the like.

It is yet another objective of the present invention to provide an improved locking mechanism that effectively prevents the unlocking or opening thereof from the outside, to thereby deter and to prevent forced entry.

It is still another objective of the present invention to provide a door or window lock that is easily operated and opened from the interior or inside of the doors or windows being locked.

It is yet another objective of the present invention to achieve such prevention of forced entry by requiring the simultaneous use of two hands for unlocking or opening of the lock of the invention.

Toward these and other ends, the door or window lock of the invention comprises a mounting frame for fixed securement to a window sash or door frame. The lock is provided with an enlarged-head blocker element that physically prevents the relative sliding movement of the movable element of the window or door assembly. The blocker element is retained in its locked or preventive state via a pivotal locking lever arm or pawl-like member the forward edge surface of which is engaged in a tooth of a series of teeth formed in the interior or frame-end of the lever arm to the exterior end of which is provided the enlarged-head block element proper. The locking lever arm is held or regained in its locking, blocker-head lever arm engaging state by two separate and independent moans. The first means is a spring-biassed, rotatable latching lever, which is normally biassed into contact with the interior, or other, end of the locking lever arm, so as to mesh with a tooth of a series of teeth thereat, whereby the lock is in its locked or latched state, where the enlarged-head blocker element is in its movement-preventing stare, and cannot be rotated out of such state, at least until the spring-biassed latching lever is rotated out of its latching state, to where it is out of contact with the interior end of the locking lever arm, whereby such locking lever arm is free to rotate after the second unlocking-preventive means has also been deactivated, so that the locking lever arm may be manually rotated out of engagement with the lever arm mounting the enlarged-head blocker element. This second means for preventing the unlocking of the lock of the invention, and specifically for preventing the rotation of the locking lever arm out of engagement with the blocker-element lever, is a pivotally-mounted shield which, in its effective state, covers over and denies hand-access to the locking lever arm and which also prevents the actual rotation of the locking lever arm by obstructing rotational movement of the locking lever arm if the latching lever were to be disengaged and moved to its open or unlocking state. The first and second preventive means also act cooperatively such that both must be moved to their unlocking states if the lock of the invention is to be placed in its unlocked or opened state. Operation of just one of the two preventive means is not adequate to unlock the lock of the invention. In addition, movement of the second preventive means, the pivotally-mounted shield, to its unlocking state will automatically prevent access to the first preventive means, the latching lever, thereby further enhancing the effectiveness and forced-entry preventiveness of the lock of the invention.

BRIEF DESCRIPTION OF THE DRAWINGS

The invention will be more readily understood with reference to the accompanying drawings, wherein.

DETAILED DESCRIPTION OF THE INVENTION

Figure 1:
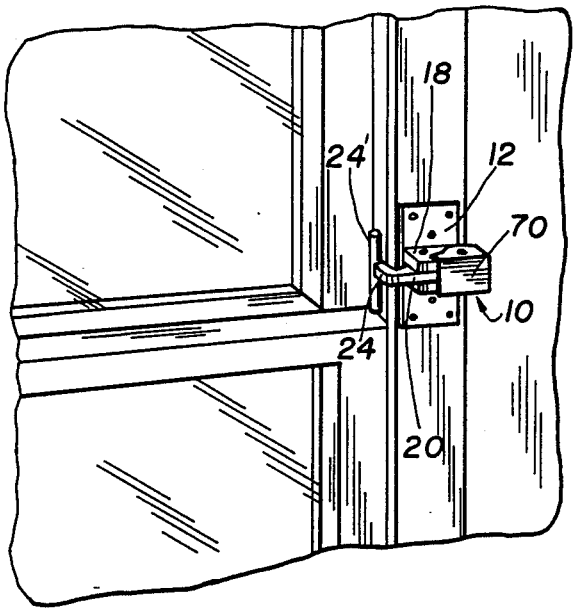
FIG. 1 is a perspective view showing the lock of the invention being used with a window sash for preventing the sliding movement thereof.
Figure 2:
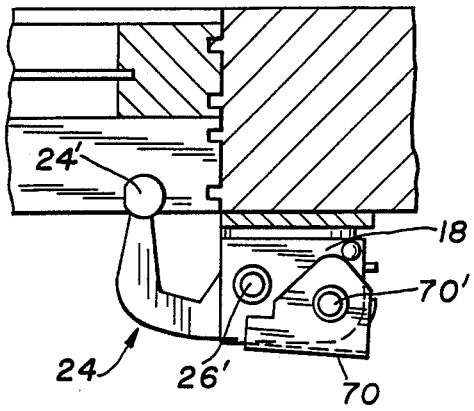
FIG. 2 is a top plan view thereof.
Figure 3:
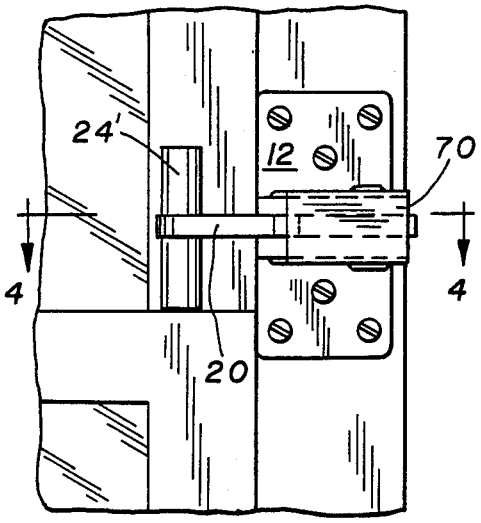
FIG. 3 is a side view thereof.
Figure 4:
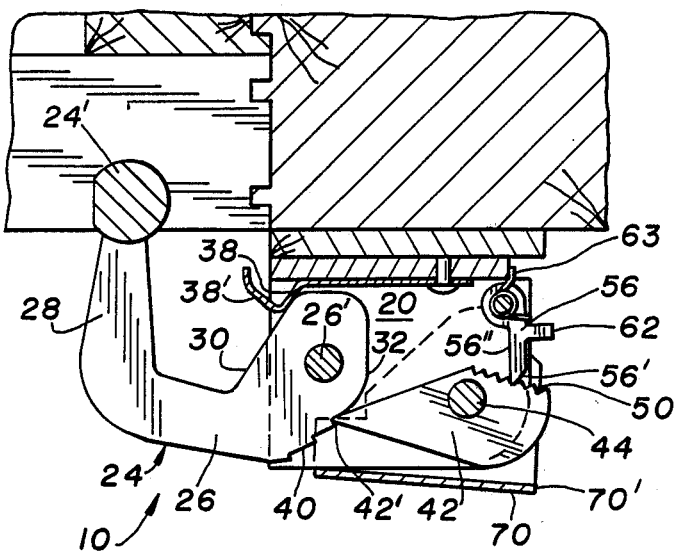
FIG. 4 is a cross-sectional view taken along line 4—4 of FIG. 3.
Figure 6:
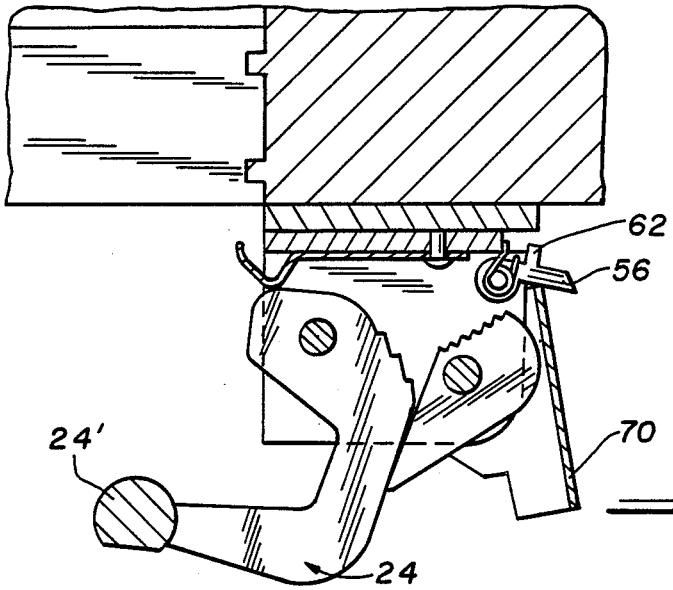
FIG. 6 is a side view similar to FIG. 5 showing the lock of the invention in its completely unlocked or opened state.
Figure 8:
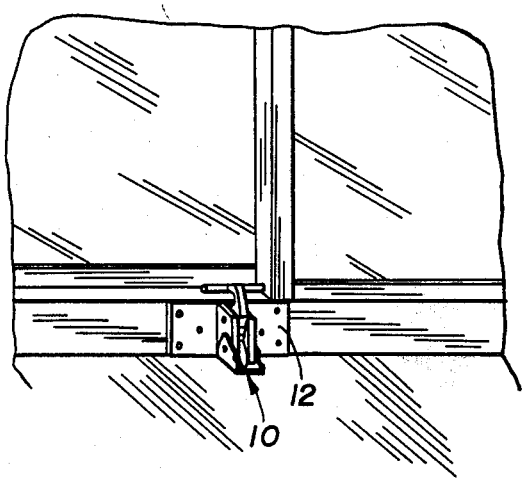
FIG. 8 is a perspective view showing the lock of the invention used for preventing the sliding movement and the opening of a patio sliding window.

Referring now to the drawings, the lock of the invention is indicated generally by reference numeral 10. The lock 10 has a generally rectangular mounting plate 12 provided with a plurality holes for screws for fixedly securing the lock 10 to a stationary portion of a frame of a window sash, as shown in FIG. 1, a patio door structure, sliding window structure as shown in FIG. 8, and the like, for preventing the slidable part of the structure from opening when the lock 10 is in its locked state. The lock 10 is provided with a pair of upstanding mounting walls 18, 20 projecting from the interior surface face of the plate 12, both of which are seen in FIG. 1, which walls 18, 20 are spaced laterally apart to define a space in which is mounted the lever operating mechanism of the lock 10, the parts of which are pivotally connected thereto, as explained below. The lever operating mechanism includes a forwardly-protruding, pivotally-mounted, blocker-arm 24 defining an enlarged blocker-head 24' at its protruding end. The blocker-arm 24 has a first leg portion 26 extending interiorly into the space between the two mounting walls 18, 20 and has an inner end thereof pivotally connected to the two walls 18, 20 via pivot shaft or rivet 26'. The inner surface of the first leg portion defines a pair of contoured surfaces 30, 32, the surface 30 being operatively associated with a spring-clip 38 at its end 38' during the locking start of the lever operating mechanism for urging the blocker-arm in the counterclockwise direction when viewing FIG. 4, so as to tend to cause the rotation of the blocker-arm into its unlocking state when the lever operating mechanism releases such blocker-arm, as described below. The spring-end 38' cooperates with the contoured surface 32, as shown in FIG. 6, when the lever operating mechanism is in its unlocked state, in order to firmly and definitively position and retain the enlarged blocker-head 24' out of the way of the door or window portion to be opened. The second leg portion 28 extends angularly with respect to the first leg portion, and mounts, at its distal, exterior end, the enlarged blocker-head 24'. The inner, contoured surface 32 is provided with a series of serrations or teeth 40 for operative engagement with a locking edge surface 42' of a pivotally-mounted locking lever or pawl 42, pivotally mounted in the space between the walls 18, 20 via rivet or pivot pin 44. In its locking state, the lever or pawl 42 meshes with one of the teeth 40 to prevent counterclockwise rotation of the blocker-arm 24, to keep it in its locking state. The inner or rearward end of the locking lever 42 defines a substantially wider or fuller portion than the end defining the wedge-edge surface 42', so as to afford a more ample surface by which one may manually rotate the locking lever 42 in the counterclockwise direction, when viewing FIG. 4, in order to unlock the device and move the block-header 24' out of the way to allow movement of the door or window, such wider portion being accessible by a finger or fingers to rotate it during unlocking, via the entrance gap between the two walls 18, 20, which entrance gap is that portion of the space between the two walls 18,20 opposite the closed end adjacent the mounting plate 12. The inner or rearward end of the locking lever 42 also defines a serrated or toothed surface 50 by which the locking lever 42 may be locked in its locking-engagement state with the blocker-arm 24, so that the counterclockwise rotation of the blocker arm is prevented. Such prevention is achieved via a pivotal, locking latching lever 56 pivotally mounted at the rearward end of the space between the two walls 18, 20, which latching lever defines a sharpened end-edge surface 56' for locking engagement with one of the teeth 50 of the locking lever 42. The latching lever 56 is pivotally connected to the walls 18, 20 via pivot shaft or rivet and biassed in the clockwise direction via a coil spring 63, so as to cause latching of the locking lever 42 in its locking state shown in FIG. 4. A projection 64 of the latching lever 56 allows for finger-gripping or pressure thereon to cause manual counterclockwise rotation of the latching lever, to thereby release the locking lever 42, and allow such locking lever 42 to be manually rotated in the unlocking, counterclockwise direction, to its unlocking state shown in FIG. 6.

Figure 5:
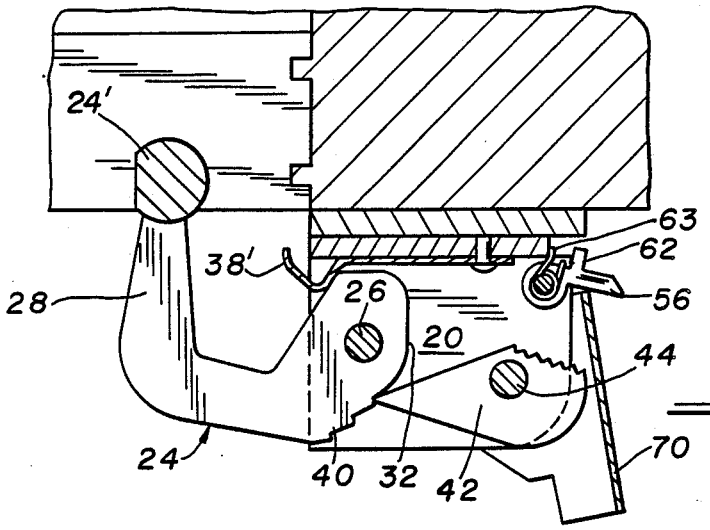
FIG. 5 is a side view similar to FIG. 4 showing the lock in its first stage of being opened or unlocked where the two lock-preventive means are moved to their unlocking state.
Figure 7:
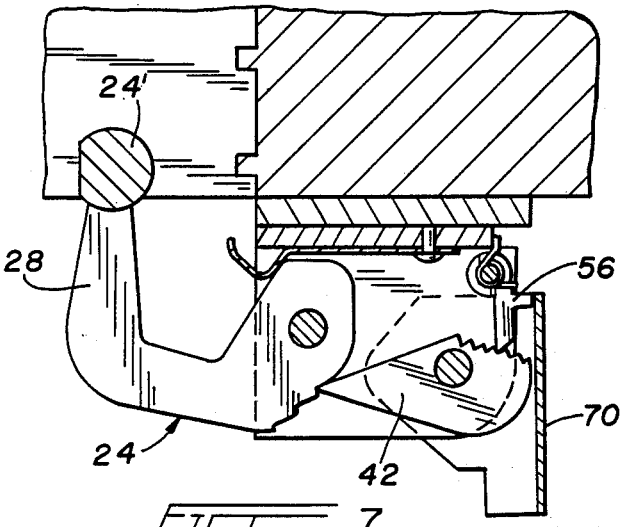
FIG. 7 is a view similar to FIG. 4 showing the outer pivotal shield pivoted to its unlocking state, whereby the latching lever is prevented from being unlocked according to the improved access-preventing nature of the invention.

Operatively associated with the locking mechanism is a pivotally-mounted safety and preventive, U-shaped shield 70 rotatably mounted to rear portions of the walls 18, 20 via rivet or pivot shaft 70''. The shield 70 may take on two operative positions. In the first state, shown in FIGS. 1–4, the shield 70 overlies the locking lever 42, and the inner or interior portion of the blocker-element 24, whereby access to the latching and locking mechanism is prevented, so that release and unlocking of the lock 10 is prevented without first releasing the latching lever 56, so that the lock may not be easily unlocked from the outside, to prevent unwanted entry, and so that a small child or toddler cannot unlock the lock, owing to the relatively greater degree of skill required to do so, to thereby prevent the child or toddler from gaining entry to an unwanted or unsafe area. When the shield 70 is in its first, locking state, even release of the latching lever 56, by rotating in the counterclockwise direction, will not allow easy unlocking of the lock, since access to the locking lever 42 is still denied unless the shield 70 is pivoted out of the way, by rotating it in the counterclockwise direction when viewing the figures. This not only aids in helping to prevent a child from unlocking the lock 10, but also increases the deterrent to unwanted entry since two hands are required to unlock the lock 10, and one must do so by operating on the lock from the interior end thereof entirely, which poses a considerable problem to a would-be burglar, or the like. The two hands are required since one hand must release the latching lever 56, while the other pivots the shield 70 out of the way to allow for rotation of the locking lever 42 in the counterclockwise direction, which is difficult to achieve from the front of the lock, as will be evident from below. In addition, the leaf spring 38 also urges the blocker-element lever arm 24 into locking engagement with the edge 42' of the locking lever 42, which also must be overcome, thereby further adding to the preventive nature of the lock 10 and the difficulty of unlocking it, unless the correct steps are taken in the proper order, as set forth below. The second state of the shield 70 is shown in FIGS. 5–7, where the shield is pivoted in the counterclockwise direction from the first state. In the second state, the shield 70 may take on one of two functions. The first function, shown in FIG. 7, is an additional safety and securement measure. If the shield 70 is rotated in the counterclockwise direction without releasing the latching lever 56 first, the shield 70 will overlie the latching lever in its locking state as shown in FIG. 7, thus preventing access to the latching lever, and thus completely preventing the unlocking of the lock 10 at all. Even with the locking lever 42 exposed, as shown in FIG. 7, such cannot be unlocked, since the latching lever 56 is not capable of being rotated to its release-position of FIG. 6, since the sleeve 70 prevents such rotation. The second function of the second state of the sleeve 70 is to allow for the unlocking of the lock 10 by first rotating the latching lever 56 into its release-state shown in FIGS. 5 and 6, and then rotating the shield 70 in the counterclockwise direction to prevent the spring-biassed latching lever 56 from returning to its latching state by holding it in its release-position shown in FIG. 5, and by allowing access to the locking lever 42 to allow for the manual rotation of the locking lever 42 in the counterclockwise direction to release same and thus unlock the lock 10, such that the lock takes the position as shown in FIG. 6, constituting the unlocked state of the lock 10. In the preferred embodiment, the latching lever 56 may also be formed with a serration or tooth 56'', or a plurality of such, which will cooperate and mesh with the interior edge surface 70' of the shield 70 when the shield is in its pivoted release-state of FIG. 6, so as to retain the latching lever in its open, unlatching state via the pivoted-down shield 70, without the need of a hand holding the shield in its release-state, which otherwise might be overcome by the bias provided by the spring 63, which would tend to return the latching lever and the shield to their locking states. However, it is within the scope and purview of the invention to provide a simple smooth surface instead of a serration or tooth for the latching lever 56, which would require greater skill and bother in retaining the lock in its unlocked state, which adds greater deterrent and preventive benefits as compared to the use of a serration or tooth 56. Another modification to bold the latching lever in its release-state would be the pivoting of the shield in a very tight manner, so that the spring-bias of spring 62 is not strong enough to overcome the tight, high-friction, pivotal mounting of the shield, to thereby keep the latching lever in its release-state via the shield proper.

While a specific embodiment of the invention has been shown and described, it is to be understood that numerous changes and modifications may be made therein without departing from the scope, spirit and intent of the invention as set forth in the appended claims.

What I claim is:

1. A lock for use in windows, sliding doors, and the like, comprising:

mounting means;

a blocker-element means for blocking and preventing movement of a door or window, said blocker-element means comprising a pivotally mounted blocker-arm having a first portion and a second portion, and a blocker-head at said second portion, and first means for pivotally mounting said first portion to said mounting means; said blocker-arm being manually rotatable about said first means for pivoting between a first locking state and a second unlocking state;

locking lever means operatively associated with said first portion of said blocker-arm for retaining said blocker-arm in said first state thereof and for allowing said second state thereof, said locking lever means comprising a locking lever having a first portion and a second portion, and a second means for pivotally mounting said first portion of said locking lever to said mounting means; said first portion of said blocker-arm having a first cooperating means, and said second portion of said locking lever having a second cooperating means, said first and second cooperating means operatively and selectively engaging to retain said blocker-arm in said first locking state thereof, said locking lever allowing said blocker-arm into said second state thereof upon manual rotation of said locking lever such that said second cooperating means is moved out of operative engagement with said first cooperating means;

means for retaining said locking lever's second cooperating means in operative engagement with said first cooperating means of said first portion of said blocker-arm, said means for retaining being selectively operatively associated and engageable with said locking lever for latching said locking lever in its locking state thereof, said means for retaining being movable between a first position in operative, latching engagement with said locking lever, and a second position out of operative, latching engagement therewith; and third means for mounting said means for retaining to said mounting means such that said means for retaining is capable of assuming said first and second positions thereof; and means for preventing rotation of said locking lever comprising a pivotal shield movable between a first state thereof preventing rotation of said locking lever, and, therefore, said blocker-arm, into its unlocking state, and a second state thereof allowing rotation of said locking lever into its unlocking state; and fourth means for pivotally mounting said shield to said mounting means.

2. The lock according to claim 1, wherein said first cooperating means comprises at least one tooth, and said second cooperating means comprises a narrowed edge surface of said second portion selectively meshing with said at least one tooth for preventing rotation of said blocker-arm in its unlocking state.

3. The lock according to claim 2, wherein said second portion of said locking lever comprises a tapering width terminating in said narrowed edge surface thereof to form a sharpened said edge surface to define thereby a pawl.

4. The lock according to claim 3, wherein said means for retaining comprises a rotatable latching lever having a first portion pivotally mounted to said mounting means, and a second portion defining a surface for selective operative engagement with said first portion of said locking lever, said first portion comprising third cooperating means and said second portion of said latching lever comprising fourth cooperating means whereby said third and fourth cooperating means selectively engage.

5. The lock according to claim 4, wherein said means for retaining further comprises means for biassing said latching lever into operative engagement with said locking lever by urging said fourth cooperating means into operative engagement with said third cooperating means, which, thereby causes said first and second cooperating means into operative engagement, to achieve the locking thereby.

6. The lock according to claim 1, wherein said blocker-element means further comprises means for biassing said blocker-arm into its unlocking state when said locking lever is released by said means for retaining.

7. The lock according to claim 1, wherein said means for retaining comprises a rotatable latching lever having a first portion pivotally mounted to said mounting means, and a second portion defining a surface for selective operative engagement with said first portion of said locking lever, said first portion comprising third cooperating means and said second portion of said latching lever comprising fourth cooperating means, whereby said third and fourth cooperating means selectively engage.

8. The lock according to claim 7, wherein said means for retaining further comprises means for biassing said latching lever into operative engagement with said locking lever by urging said fourth cooperating means into operative engagement with said third cooperating means, which, thereby causes said first and second cooperating means into operative engagement, to achieve the locking thereby.

9. The lock according to claim 1, wherein said shield and said means for retaining comprise means for holding said means for retaining in its said second position when said shield is in its said second state thereof.

10. The lock according to claim 1, in combination with one of a slidable patio door, a slidable patio window, and a sliding sash window; said lock being mounted to a stationary portion thereof such that said blocker head of said blocker-arm prevents movement of the slidable part therepast.

* * * * *